US009662924B2

(12) United States Patent
Ruiz Suesa et al.

(10) Patent No.: US 9,662,924 B2
(45) Date of Patent: May 30, 2017

(54) AUTOMATIC HANDLING AND TRANSPORT DEVICE FOR PRINTING SLEEVES

(71) Applicant: NEOPACK S.L., Riudellots de la Selva (Girona) (ES)

(72) Inventors: Luis Antonio Ruiz Suesa, Barcelona (ES); Jordi Puig Vila, Bescanó (ES); Adelbert Lucas Schoonman, Canet d'Adri (ES); Antonio Garrido Fernández, Cassàde la Selva (ES)

(73) Assignee: NEOPACK S.L., Riudellots de la Selva (Girona) (ES)

( * ) Notice: Subject to any disclaimer, the term of this patent is extended or adjusted under 35 U.S.C. 154(b) by 0 days.

(21) Appl. No.: 15/027,511

(22) PCT Filed: Sep. 30, 2014

(86) PCT No.: PCT/IB2014/001954
§ 371 (c)(1),
(2) Date: Apr. 6, 2016

(87) PCT Pub. No.: WO2015/052562
PCT Pub. Date: Apr. 16, 2015

(65) Prior Publication Data

US 2016/0243872 A1 Aug. 25, 2016

(30) Foreign Application Priority Data

Oct. 7, 2013 (EP) ..... 13380046

(51) Int. Cl.
*B41F 30/04* (2006.01)
*B41N 6/00* (2006.01)
*B41F 27/10* (2006.01)

(52) U.S. Cl.
CPC ..... *B41N 6/00* (2013.01); *B41F 27/105* (2013.01); *B41F 30/04* (2013.01); *B41P 2227/21* (2013.01)

(58) Field of Classification Search
CPC ..... B41N 6/00; B41F 27/105; B41F 30/04; B41P 2227/21; B41P 2227/20
(Continued)

(56) References Cited

U.S. PATENT DOCUMENTS

2002/0056392 A1* 5/2002 Sameit ..... B41F 13/0016 101/484
2007/0214978 A1* 9/2007 Puig Vila ..... B41F 27/1206 101/174
2009/0028613 A1* 1/2009 Plasswich ..... B41F 27/105 399/297

FOREIGN PATENT DOCUMENTS

EP 1093914 A2 4/2001
EP 1591248 A1 11/2005
(Continued)

*Primary Examiner* — Leslie J Evanisko
(74) *Attorney, Agent, or Firm* — Robert J. Hess; Hess Patent Law Firm

(57) ABSTRACT

An automatic handling and transport device for printing sleeves that includes a holding support (10) for printing sleeves (60) and a clamping carriage (20) connected to a motorized carriage (30) for a guided movement of the clamping carriage (20) between a gripping position for gripping sleeves (60) and a transport position, and a mobile handling unit (90) carrying the holding support (10). The holding support (10) has an inner core (12) attached to the mobile handling unit (90), and the holding support (10) is coupled to the core (12) or to the mobile handling unit (90) through adaptable support means (40), which provide a relative movement with respect to the core (12) to at least one of the two ends of the holding support (10). The connection of the clamping carriage (20) to the motorized
(Continued)

carriage (30) comprises adaptable means (49) that allow a relative movement between the clamping carriage (20) and the motorized carriage (30).

14 Claims, 8 Drawing Sheets

(58) Field of Classification Search
USPC ..... 101/477, 375, 479, 480
See application file for complete search history.

(56) References Cited

FOREIGN PATENT DOCUMENTS

| | | | |
|---|---|---|---|
| EP | 1776231 | B2 | 7/2011 |
| EP | 1705009 | B1 | 1/2013 |
| WO | WO 2015/052562 | | 4/2015 |

* cited by examiner

AUTOMATIC HANDLING AND TRANSPORT DEVICE FOR PRINTING SLEEVES

TECHNICAL FIELD

This invention relates to an automatically operated device that can be applied to handling and transporting printing sleeves, said device being associated with a mobile unit for performing sleeve replacement operations in a printing machine, with the machine shut down or operating, in a completely automatic manner, without the intervention of operators, also being suitable for performing any maneuver or operation for moving and storing printing sleeves between a storage area and the machine, inside the actual storage area or between zones of the actual machine.

BACKGROUND OF THE INVENTION

Patent EP-B1-1705009 describes an automatic handling and transport device for printing sleeves which enables performing printing sleeve changing operations in a flexographic printer while the flexographic printer is operating, said device comprising a sleeve holding support that can be positioned in alignment with a sleeve-bearing shaft and in proximity with same and a securing tool configured for being moved by moving means between a transfer position, in which said securing tool interacts with said sleeve installed on said sleeve-bearing shaft to hold it or release it by one end, and a transport position in which the sleeve secured by the securing tool is left arranged on said holding support of the device. The device for automatic handling is installed in a basic mobile unit prepared for moving the device in a first direction (X) and in a second direction (Y), transverse to said first direction (X) and parallel to said sleeve-bearing shaft to provide said alignment positions.

The device explained in said background document can present alignment problems if sleeves of considerable weight are to be handled, as is the case of the sleeves of an offset printing machine, and in any case the operation of transferring the sleeves from the sleeve-bearing shaft of the machine to the holding support of the device is a critical aspect of the operating cycle, in that machine shaft misalignments with respect to an initial or theoretical position of said holding support and positioning inaccuracies can result in the sleeve being jammed during transfer to or from the described holding support, which must be kept perfectly co-aligned at all times with said sleeve-bearing shaft of the machine.

Patent EP-B2-1776231 describes a system for the replacement of sleeves of a printing machine where there has been provided a basic mobile unit, consisting of a known programmable robotic manipulator with two rotational joints, and pushing means arranged both in the printing machine and in a holding support of said robotic manipulator in order to transfer said sleeves to and from said holding support by pushing means. To transfer printing sleeves, the printer is equipped with pushing devices, and the robotic manipulator lacks means for the extraction of the sleeves itself by means of pulling on them, this operation depending on the pushing devices of the printer.

With regard to transferring the sleeves from the shafts of the printing machine to the support of the manipulator and vice versa, this second background document has the same problems derived from the weight of the sleeves and misalignments between shaft and support mentioned above, in addition to requiring pushing means arranged in the printer, making it difficult to implement or preventing the implementation of this sleeve changing system in already existing printers.

The invention object of the present patent application proposes an automatic device that is intended for facilitating the transfer of printing sleeves of any class, span and weight to or from a sleeve-bearing shaft of the machine and to or from a holding support arranged in co-alignment with said shaft, almost completely eliminating the possibility of said jams as a result of a self-alignment system, also being suitable for moving and arranging said sleeves in a storage area.

BRIEF DESCRIPTION OF THE INVENTION

The present invention relates to an automatic handling and transport device for printing sleeves, equipped with a mobile handling unit at the end of which there is firmly fixed by one of its ends at least one supporting inner core which is cantilevered from that proximal end of attachment.

Attached to said supporting inner core there is a holding support serving as a support for arranging thereon the printing sleeves for handling and transport. Said holding support is attached to the supporting inner core or to the mobile handling unit by means of adaptable support means, such that said holding support has a relative movement with respect to said supporting inner core at least in a two-dimensional plane, a relative three-dimensional movement being preferred. Said adaptable support means can be of an elastic, compressible or adjustable nature.

A clamping carriage equipped with gripping means configured for being able to grip a printing sleeve runs longitudinally on said holding support, operated by means of a motorized carriage. As a non-limiting example, said motorized carriage is operated by means of the rotation of a screw spindle, by means of a drive chain or a notched guide.

The motorized carriage and the clamping carriage are attached by means of adaptable carriage means that allow at least a two-dimensional relative movement between both carriages, a three-dimensional movement being preferred. Said adaptable carriage means can be of an elastic, compressible or adjustable nature.

Both the adaptable support means and the adaptable carriage means can have positioning means that maintain the relative position of the members in a specific position as long as the stresses to which they are subjected do not exceed certain pre-established parameters.

BRIEF DESCRIPTION OF THE DRAWINGS

The foregoing and other features and advantages will become more evident from the following detailed description of an embodiment in reference to the attached drawings in which.

DETAILED DESCRIPTION OF AN EMBODIMENT

Figure 1:
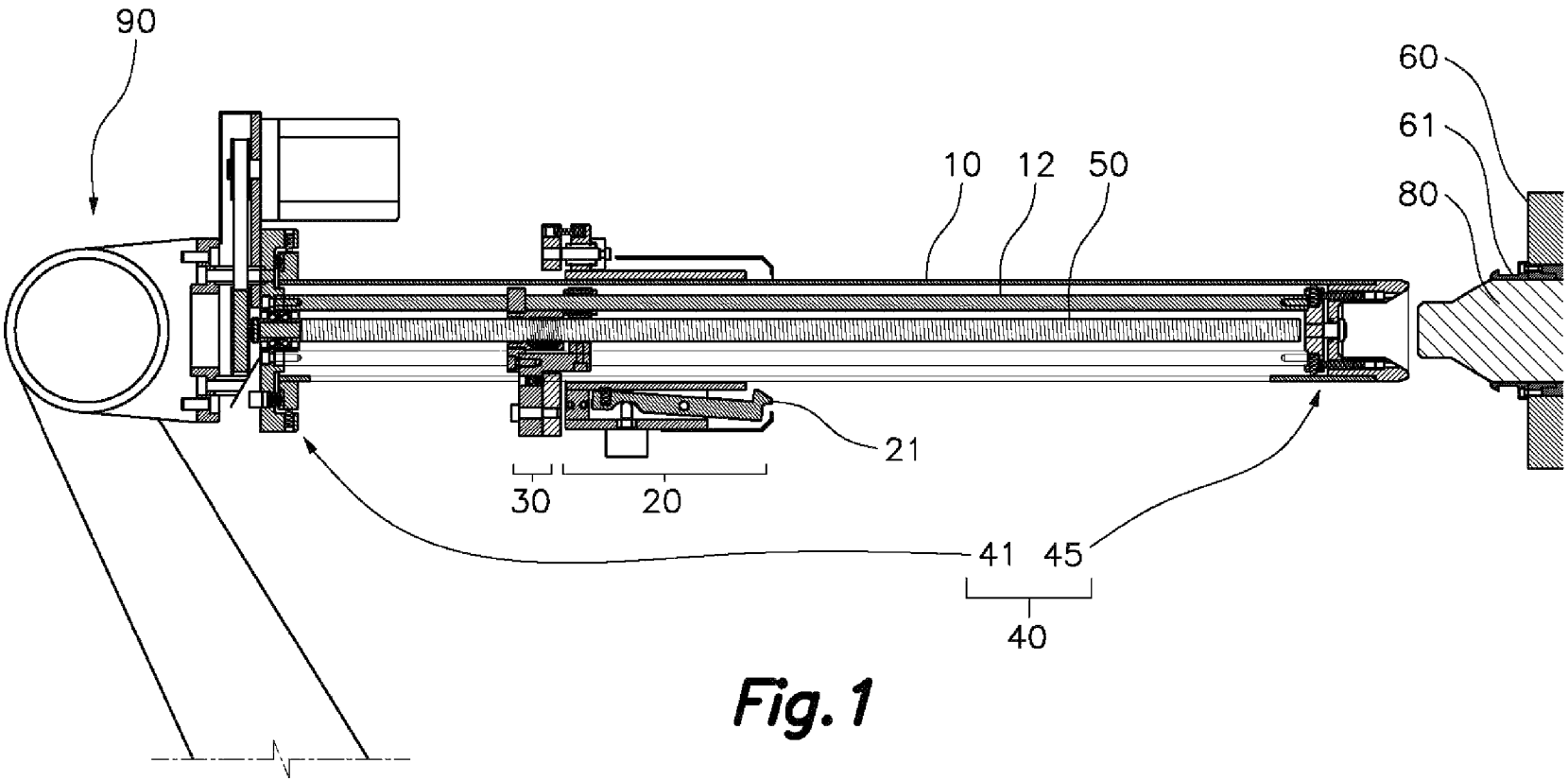
FIG. 1 shows a longitudinal section of the holding support, held in cantilever from one of its ends by a device for automatic handling in a situation of axial co-alignment with a sleeve-bearing shaft of a printing machine.
Figure 2:
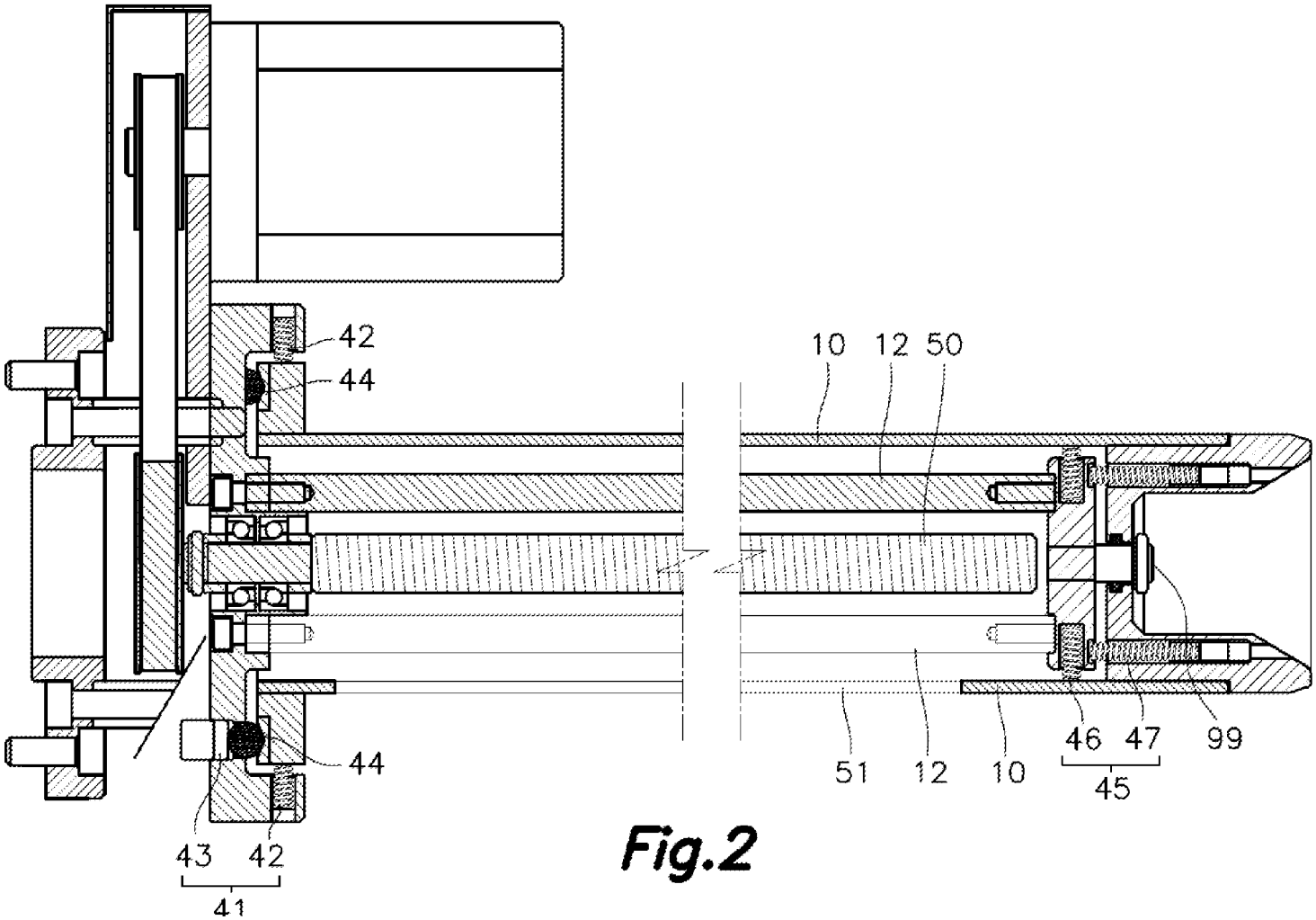
FIG. 2 is an enlarged view of the proximal and distal ends (with respect to said device for automatic handling) of said holding support sectioned longitudinally.
Figure 3:
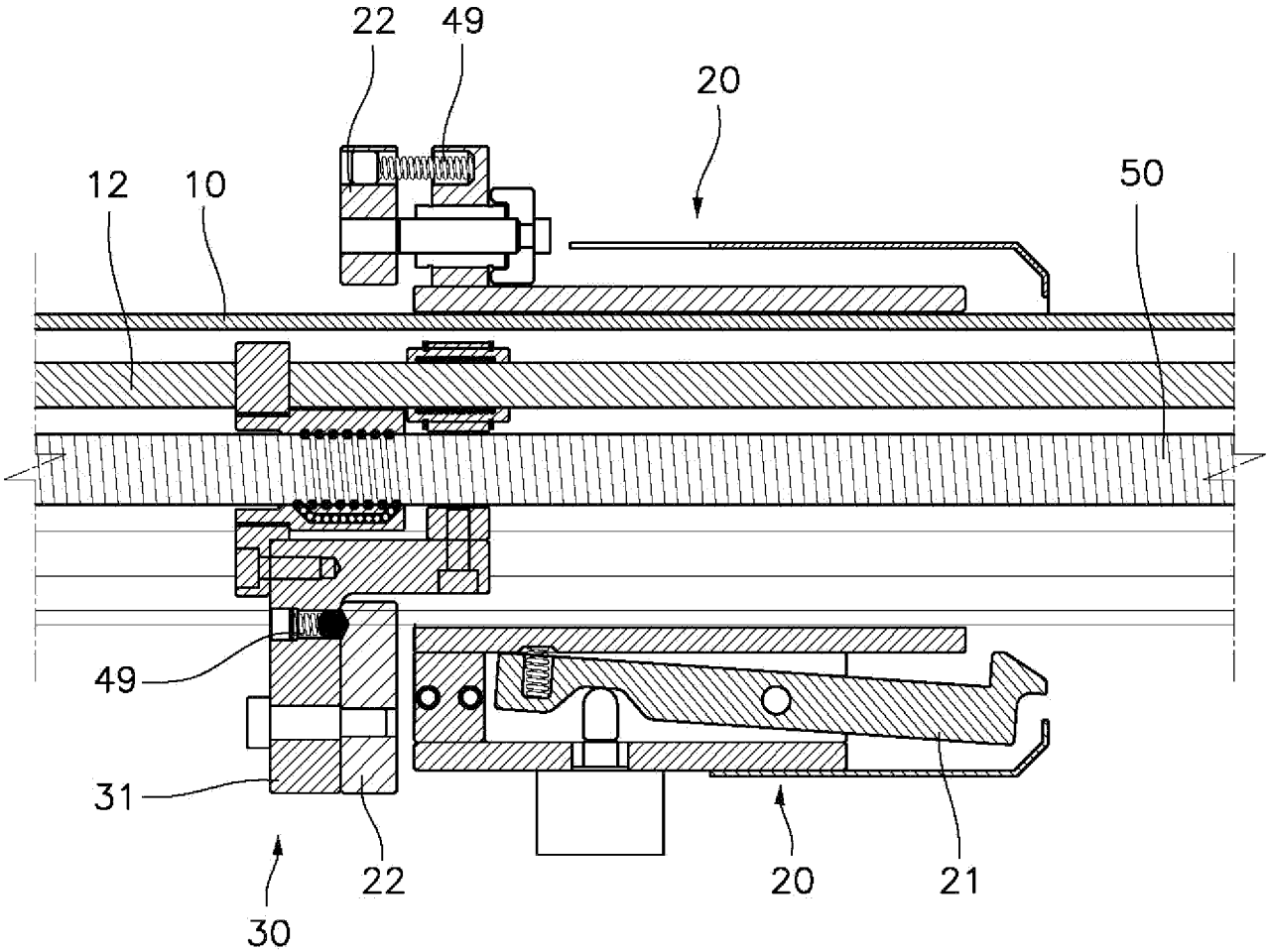
FIG. 3 shows an even more enlarged view of a central section of said holding support, together with the motorized carriage, the clamping carriage and the gripping means sectioned longitudinally.

FIGS. 1 and 2 show an automatic handling and transport device for printing sleeves 60 comprising a mobile handling unit 90 carrying a holding support 10, which is tubular in this embodiment, and prepared for spatial orientation and positioning in relation to a sleeve-bearing shaft 80 or in relation to a centering member for storage of sleeves 60.

Said holding support 10 has at least one supporting inner core 12 which is firmly attached by one of its ends to a head of said mobile handling unit 90 and cantilevered. According to the non-limiting embodiment shown in FIGS. 4A to 4E, said supporting inner core consists of three cylindrical bars arranged inside the holding support 10, or at least inscribed in the inner space of the hollow core of a sleeve, with a uniform angular separation between them, other configurations with a different number, position or geometry of the members forming said supporting inner core being possible.

The holding support 10 is coupled to said supporting inner core 12 or to the body of said mobile handling unit 90 through adaptable support means 40 which provide at least a two-dimensional relative movement to at least one of the two ends of said holding support 10.

Should any minor misalignment arise between said holding support 10 and the geometric axis of the sleeve 60 it is to receive like a casing as said sleeve 60 is being moved coaxially over the holding support 10, this relative movement allows operating said adaptable support means 40 to self-align said holding support 10 with the axis of the sleeve 60, thus preventing any jam situation from occurring.

In the example described in FIG. 2, said adaptable support means 40 consist of adaptable proximal means 41 located at the proximal end of the holding support 10, and of adaptable distal means 45 located at the distal end of the holding support 10.

Said adaptable proximal means 41 and adaptable distal means 45 provide a relative three-dimensional movement between the holding support 10 and the supporting inner core 12, providing two-dimensional movement in a plane perpendicular to the holding support 10, by means of adaptable proximal radial means 42 and adaptable distal radial means 46. Relative movement in a third axial axis is also achieved as a result of adaptable proximal axial means 43 and adaptable distal axial means 47, thereby achieving an overall relative three-dimensional movement.

In the example shown in FIG. 2, said adaptable proximal radial means 42 of an elastic nature are arranged outside the holding support 10, allowing ample relative movement of said proximal end, and the adaptable distal radial means 46, also of an elastic nature, are arranged inside said holding support 10, which thus allows keeping the outer perimeter of the distal end of the holding support 10 interference-free.

According to one embodiment, the adaptable support means 40 are formed by springs, but other devices could be used instead, such as, for example, gas pistons, hydraulic pistons, elastomers, magnets, or any other material or device that allows attaching two segments, enabling relative movement.

As can be seen in FIG. 2, associated with the adaptable proximal axial means 43 there are first positioning means 44 configured so that the radial relative movement does not occur as long as the radial force applied on the holding support 10 does not exceed the force produced by the weight of a sleeve 60, said radial relative movement therefore only occurs when attempting to introduce the sleeve 60 in the holding support 10 and the latter is misaligned with respect to the geometric axis of said sleeve 60.

According to an embodiment shown in FIG. 2, said first positioning means 44 consist of a spherical body pressed against a concave body, said concave body being attached to the holding support 10, and said spherical body is arranged between said concave body and the adaptable proximal axial means 43, or vice versa, which are calibrated to keep said spherical body inside said concave body as long as the force applied on the holding support 10 does not exceed previously mentioned parameters. Therefore, since the spherical body is inside the concave body, the holding support 10 is in a rest position with respect to the supporting inner core 12.

To drive the sleeve 60 along the holding support 10, a clamping carriage 20 equipped with gripping means 21 is connected to a motorized carriage 30, which allows movement between a gripping position (shown in FIGS. 5C and 5D) in which said gripping means 21 interact with a sleeve 60 to hold it or release it, and a transport position (shown in FIGS. 5E and 5F) in which said holding support 10 is partly or completely coupled with said sleeve 60.

Given that said clamping carriage 20 runs along the holding support 10 and the latter has a relative three-dimensional movement with respect to the supporting inner core 12 and to the mobile handling unit 90, said clamping carriage 20 also has that relative movement in order to remain aligned with the axis of the holding support 10 at all times.

Figure 4A:
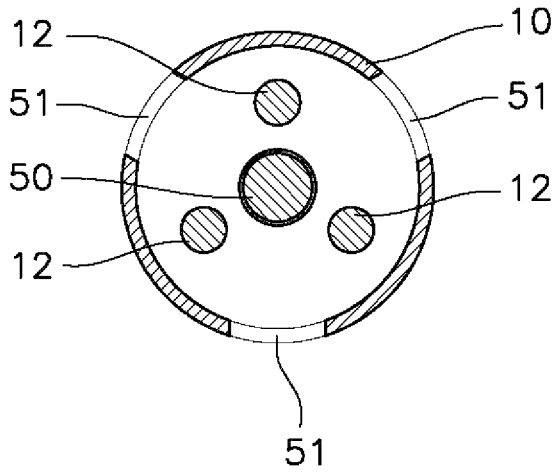
FIG. 4A shows a cross-section of the holding support and of a screw spindle and guiding bars arranged therein.
Figure 4B:
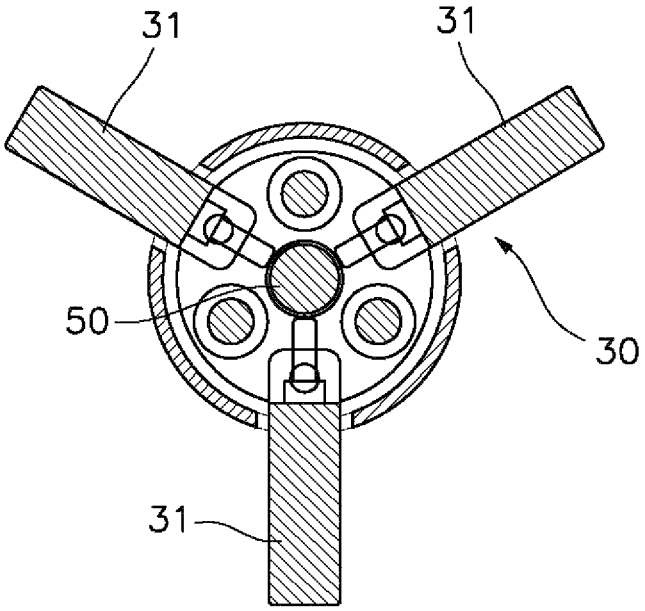
FIG. 4B shows a cross-section of the holding support and of the motorized carriage, together with their three arms.
Figure 4C:
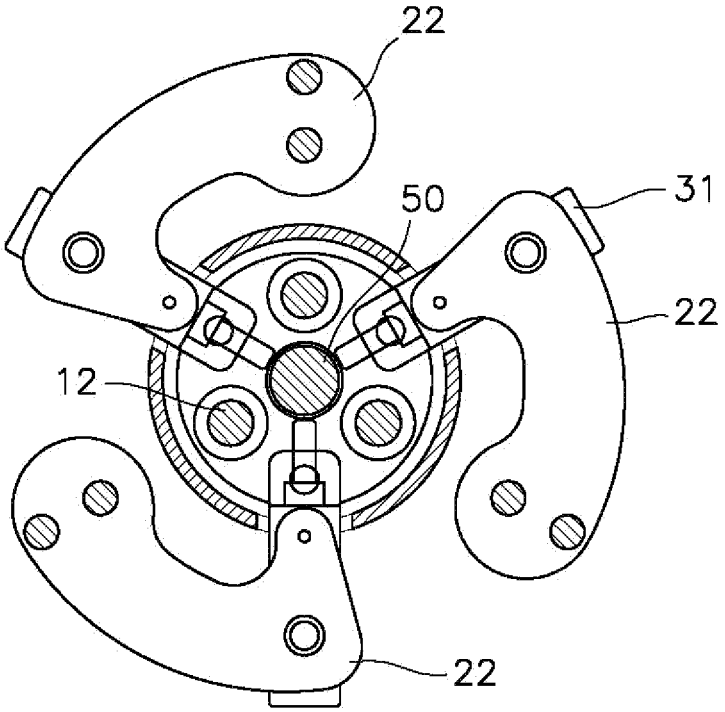
FIG. 4C shows a cross-section of the holding support and of the coupling plates which attach the motorized carriage with the clamping carriage.
Figure 4D:
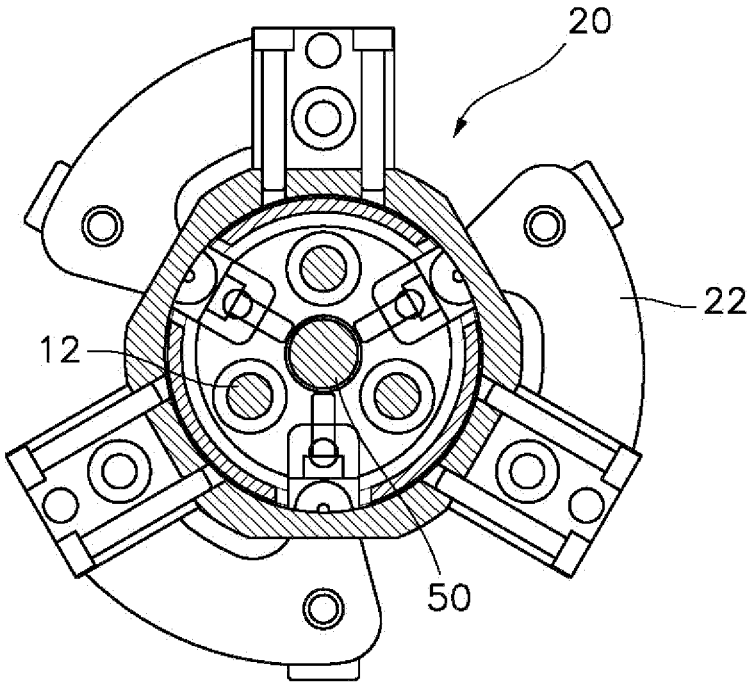
FIG. 4D shows a cross-section of the holding support and of the clamping carriage.
Figure 4E:
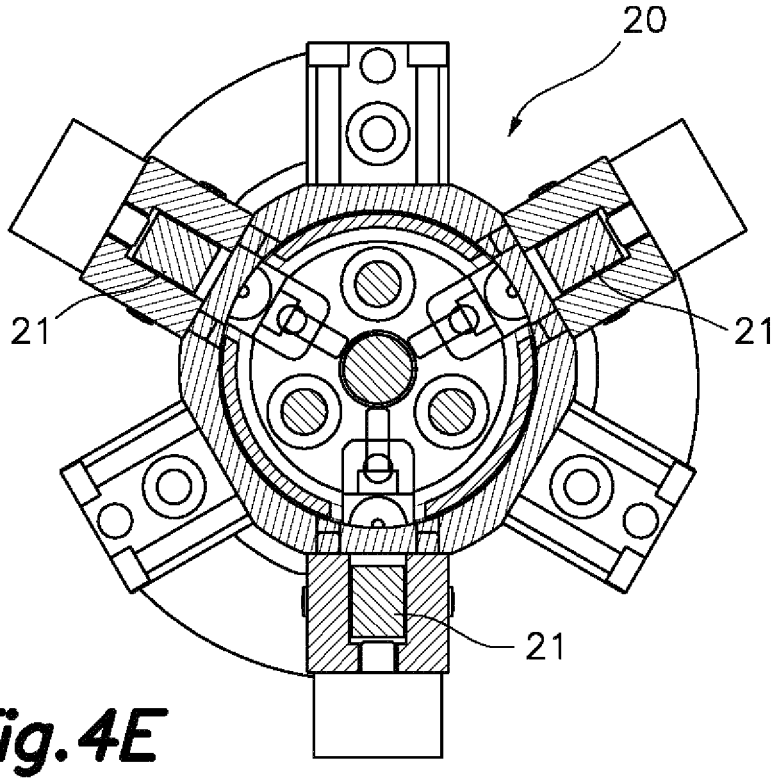
FIG. 4E shows a cross-section of the holding support, of the clamping carriage, and of the gripping means.

The embodiment shown in FIG. 3 and FIGS. 4A to 4E shows a motorized carriage 30 mechanically attached to at least one central screw spindle 50 coupled to the mobile handling unit 90 and arranged inside the holding support 10, such that the rotation of said screw spindle 50 causes the axial movement of said motorized carriage 30. The motorized carriage 30 is connected to the clamping carriage 20 through arms 31 through longitudinal openings 51 of said holding support 10, as can be seen in FIG. 4B. There are connected on said arms 31 by means of adaptable carriage means 49 coupling plates 22, such as those shown in FIG. 4C, to the end of which there is fixed the clamping carriage 20 equipped with the gripping means 21 (FIGS. 4D and 4E).

The combination of said adaptable carriage means 49 (in this example of an elastic nature) with the geometry of said coupling plates 22 allows a relative movement between the motorized carriage 30 and the clamping carriage 20. Therefore by holding an annular grip 61 provided in the accessible head of the sleeve 60, the gripping means 21 can orient the entire clamping carriage 20 with respect to the geometric axis of the sleeve 60 and not with respect to the axis of the holding support 10 on which the clamping carriage 20 is assembled with the possibility of sliding.

Said adaptable carriage means 49 can have second positioning means similar to those described above and located at the proximal end of the holding support 10. Said second positioning means can be calibrated with less tension, for example, than the first positioning means 44.

In an optional and non-limiting manner, the mobile handling unit 90 or the holding support 10 can have sensor means intended for positioning and/or identifying the sleeves and/or their supports, which allows improving automatic self-positioning. It can also have position sensors 99 that detect or allow inferring the relative position between the holding support 10 and the supporting inner core 12 in order to know the existing degree of misalignment, thereby allowing future corrections of the self-positioning.

Figure 5A:
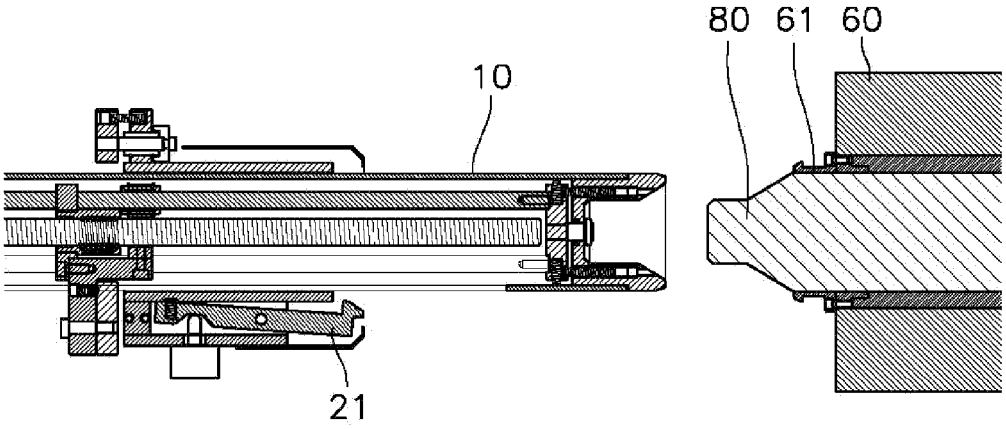
FIG. 5A shows a longitudinal section view of a first step of the method of handling a printing sleeve, consisting of the coaxial alignment of the holding support with a sleeve-bearing shaft.
Figure 5B:
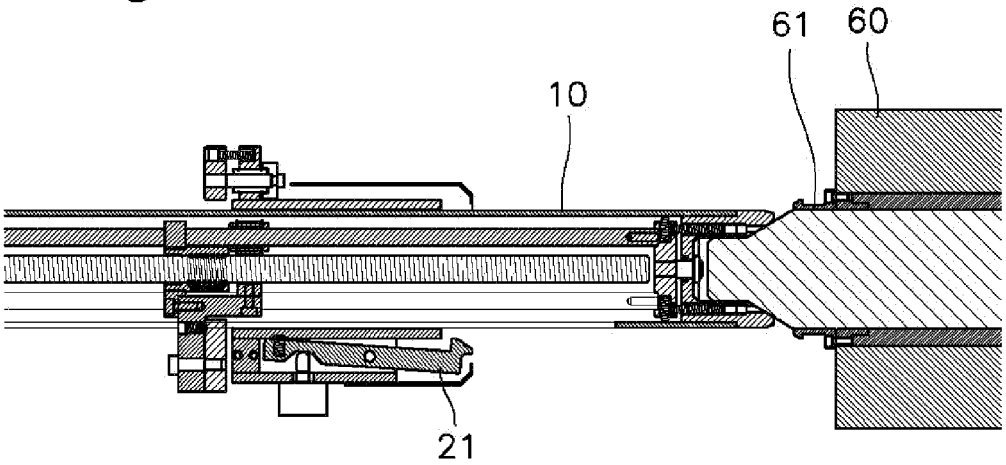
FIG. 5B is a longitudinal section view of a second step of the method of handling a printing sleeve, consisting of the coupling of the distal end of the holding support with the sleeve-bearing shaft.
Figure 5C:
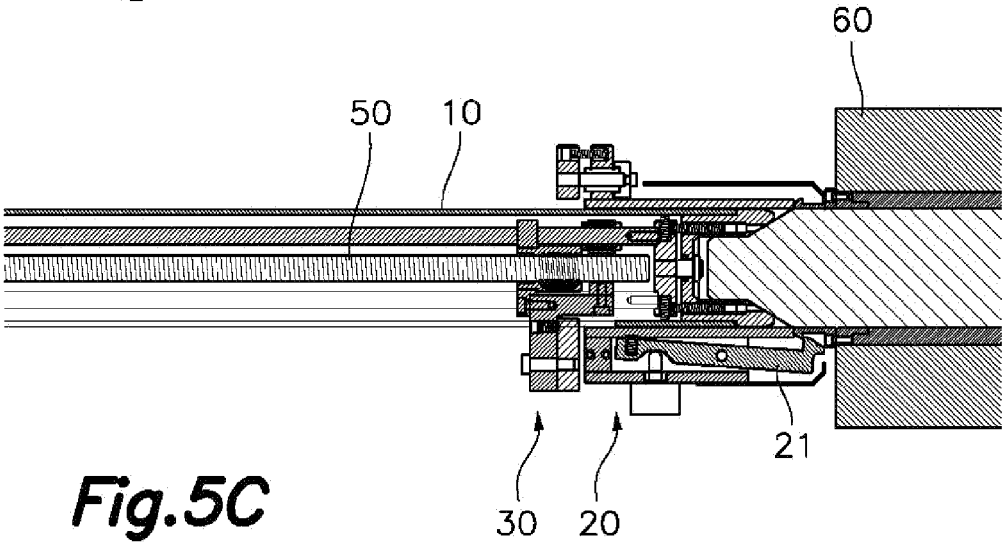
FIG. 5C shows a longitudinal section view of a third step of the method of handling a printing sleeve, consisting of the movement of the clamping carriage to the gripping position.
Figure 5D:
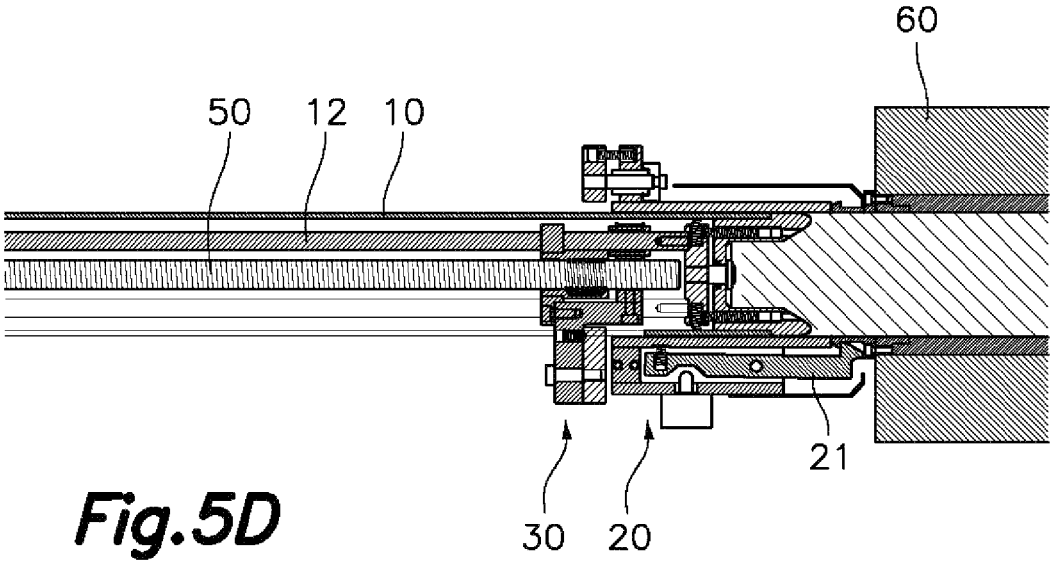
FIG. 5D shows a longitudinal section view of a fourth step of the method of handling a printing sleeve, consisting of the gripping means gripping of the sleeve through an annular grip or flange of its end.
Figure 5E:
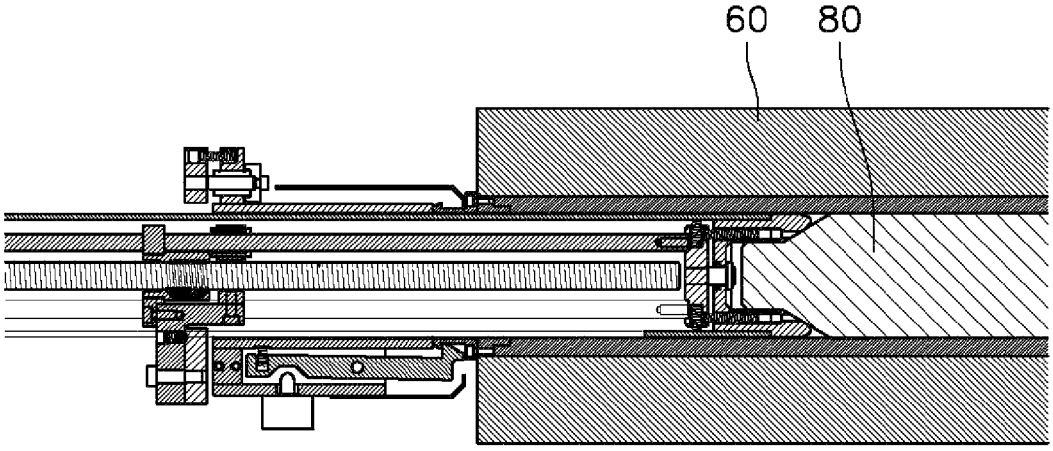
FIG. 5E is a longitudinal section view of a fifth step of the method of handling a printing sleeve, consisting of the movement of the clamping carriage towards the transport position, which drives the printing sleeve that is supported on said holding support.
Figure 5F:
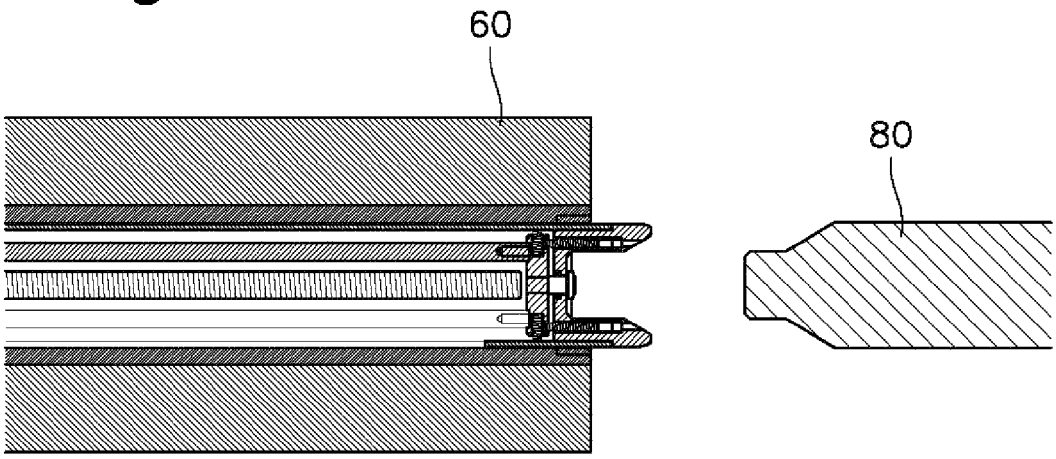
FIG. 5F shows a longitudinal section view of a sixth step of the method of handling a printing sleeve, consisting of decoupling the distal end of the holding support from the sleeve-bearing shaft once the sleeve is in the coaxial transport position and resting on said holding support.

The method for the automatic handling and transport of sleeves 60 is the same as the one commonly used in other devices of this type, and it can be clearly understood upon analyzing the sequences shown in FIGS. 5A to 5F. Said method includes a first step in which the mobile handling unit 90 aligns the holding support 10 with the sleeve-bearing shaft 80 or with a storage position (FIG. 5A). In a second step it couples the distal end of the holding support 10 with the distal support of the sleeve-bearing shaft 80 (FIG. 5B). In the third step shown in FIG. 5C, the clamping carriage 20 is positioned in the previously mentioned gripping position to then in the fourth step close the gripping means 21, thereby gripping the sleeve 60 (FIG. 5D). In the fifth step the motorized carriage 30 moves the clamping carriage 20, driving the sleeve 60 with it (FIG. 5E) by the annular grip 61. It is during this step that said adaptable support means 40 can enter into action if the axis of the sleeve 60 and the axis of the holding support 10 are not perfectly aligned and coaxial. In a sixth step the holding support 10 is decoupled from the sleeve-bearing shaft 80 once the sleeve 60 is completely in the transport position coaxial to the mentioned holding support 10.

The invention claimed is:

1. An automatic handling and transport device for printing sleeve comprising:

a holding support for printing sleeve that can be positioned in proximity with a sleeve-bearing shaft, axially co-aligning a printing sleeve axis with said sleeve-bearing shaft or with a centering member of a storage area;

a clamping carriage equipped with gripping member and connected to a motorized carriage for a guided movement of said clamping carriage along said holding support between a gripping position in which said gripping member interact with said sleeve to hold or release said sleeve, and a transport position in which said holding support is partly or completely inserted into said sleeve; and a mobile handling unit carrying said holding support and prepared for spatial orientation and positioning thereof in relation to said sleeve-bearing shaft or in relation to said centering member of the storage area;

wherein the holding support has at least one supporting inner core, which is firmly attached by one of its ends to a head of said mobile handling unit; and the holding support is coupled to said supporting inner core or to the body of said mobile handling unit through elastic or compressible adaptable support means, which provide relative movement of at least one of the two ends of said holding support with respect to the supporting inner core in at least a two-dimensional plane.

2. The device according to claim 1, wherein said elastic or compressible adaptable support means provide a relative movement of both ends of said holding support with respect to the supporting inner core in three dimensions.

3. The device according to claim 2, wherein said elastic or compressible adaptable support means include a part located at a proximal end of said holding support, and a part located at a distal end of said holding support.

4. The device according to claim 3, wherein said part of the elastic or compressible adaptable support means located at a proximal end of said holding support adapted to act in a plane perpendicular to the holding support, and adapted to act in the longitudinal direction of the holding support.

5. The device according to claim 4, wherein said part of the elastic or compressible adaptable support means located at a proximal end of said holding support acting in the longitudinal direction of the holding support are associated with a spherical body arranged between said part of the elastic or compressible adaptable support means and a concave body attached to the holding support, said spherical body being pressed against said concave body with enough force so that the holding support is maintained in a rest position with respect to the supporting inner core as long as force applied on the holding support does not exceed the force produced by weight of the sleeve.

6. The device according to claim 5 further comprising gripping member for holding an annular handle of said sleeve on an accessible head thereof.

7. The device according to claim 3, wherein said part of the elastic or compressible adaptable support means located at a distal end of said holding support adapted to act in a plane perpendicular to the holding support, and adapted to act in the longitudinal direction of the holding support.

8. The device according to claim 1, wherein said clamping carriage is connected to the motorized carriage through elastic or compressible member that allow at least a two-dimensional relative movement between the clamping carriage and the motorized carriage.

9. The device according to claim 8, wherein said motorized carriage is attached to the clamping carriage and also mechanically connected with at least one screw spindle by arms passing through longitudinal openings of the walls of said holding support, said screw spindle being coupled to the mobile handling unit and arranged inside the holding support.

10. The device according to claim 9, wherein said motorized carriage is connected to said clamping carriage by coupling plates fixed to said arms of the motorized carriage.

11. The device according to claim 9, wherein said supporting inner core comprises equidistant guiding bars integral with the head of said mobile handling unit and surrounding the mentioned screw spindle for the guided movement of the clamping carriage.

12. The device according to claim 11, wherein said motorized carriage is operated by the rotation of said screw spindle.

13. The device according to claim 1, further comprising position sensors that allow knowing relative position between the holding support and the supporting inner core.

14. The device according to claim 1, wherein distal end of the holding support comprises a flared funnel-like configuration that facilitates coupling with an end portion of the sleeve-bearing shaft.

* * * * *